United States Patent [19]

Arnold, deceased

[11] 4,341,338

[45] Jul. 27, 1982

[54] CORRUGATED BOX BULK MATERIALS

[75] Inventor: Emmons S. Arnold, deceased, late of Grove City, Ohio, by Bonnie K. Arnold, executrix

[73] Assignee: Owens-Illinois, Inc., Toledo, Ohio

[21] Appl. No.: 162,219

[22] Filed: Jun. 23, 1980

[51] Int. Cl.[3] ..... B65D 5/42

[52] U.S. Cl. ..... 229/23 BT; 229/48 R

[58] Field of Search ..... 229/23 AB, 23 AT, 48 R, 229/485 A, 485 B; 206/586; 220/416, 441

[56] References Cited

U.S. PATENT DOCUMENTS

| | | | |
|---|---|---|---|
| 584,072 | 6/1897 | Church | 229/48 R |
| 2,611,529 | 9/1952 | Currinan | 220/416 |
| 2,732,996 | 1/1956 | Pantalone | 220/416 |
| 2,965,280 | 12/1960 | Muller | 220/416 |
| 3,397,831 | 8/1968 | Adams | 206/586 |
| 3,957,196 | 5/1976 | Kellerman | 206/586 |
| 4,068,796 | 1/1978 | Kullman | 220/416 |
| 4,081,124 | 3/1978 | Hall | 220/441 |

*Primary Examiner*—Herbert F. Ross

*Attorney, Agent, or Firm*—John R. Nelson; Myron E. Click; David H. Wilson

[57] ABSTRACT

The invention comprises a corrugated container for high density bulk materials. The side walls of a box or inner tube for a box are formed from two separate corrugated pieces, connected by overlapping seams. Each overlapping piece has a free end which is scored and folded to form an integral vertical support post, in the form of a vertically disposed triangular prism, the apex of which extends towards the interior of the box. The free end of each overlapping piece is tucked within the seam overlap, to secure the triangular post. The triangular vertical support posts in the side walls of the tube increase the stiffness of the side walls to prevent them from bulging under the pressure of the bulk material contained within the box. To increase the strength of the box against stacking forces and internal pressures, the inner box or tube may be placed snugly within an outer corrugated box.

7 Claims, 3 Drawing Figures

CORRUGATED BOX BULK MATERIALS

BACKGROUND OF THE INVENTION

Strengthening ribs on corrugated containers for bulk materials are desirable for bulge resistance and stacking strength, and are known in the prior art.

In U.S. Pat. No. 3,097,781 which issued July 16, 1963 to J. J. Masi, there is disclosed a paper board container with internally projecting, vertically disposed, triangular shaped reinforcing posts, integral with the side wall. However, this design places the support posts near the corners of the box, where they are least effective to provide bulge resistance. Furthermore, the Masi patent provides for the construction of the four side walls from three pieces of paper board, and requires a complicated construction procedure. U.S. Pat. Nos. 4,081,124 issued Mar. 28, 1978 to D. Y. Hall, and 3,159,326, issued Dec. 1, 1964 to D. A. Stonebanks, also disclose fiber board containers with inwardly projecting vertically disposed triangular shaped reinforcing posts. In these designs the reinforcing post is formed from a vertical fold in the middle of a side wall, not involving an end of a side wall. Some means, such as the jig disclosed in U.S. Pat. No. 4,081,124, must be provided to hold the side walls in this folded configuration during construction of the box.

There is a need for a reinforced corrugated container for bulk materials, which can be easily manufactured and erected from a small number of corrugated parts.

SUMMARY OF THE INVENTION

The invention comprises a rectangular corrugated shipping box for bulk material, having integral corrugated vertical reinforcing posts to provide bulge resistance and stacking strength. The side walls of the shipping box are formed from two identical corrugated wall pieces. Each wall piece is originally in the general shape of an elongated rectangle. Each wall piece has two scored vertical lines on which the piece is folded to form right angles. So folded, each wall piece forms one end wall between the folded corners and part of each adjacent side wall. The two identical wall pieces are aligned with the end walls parallel and opposite each other, with each side wall portion generally aligned with and substantially overlapping the corresponding side wall portion of the other wall piece. The side wall sections are glued or stitched together at the overlap, thereby forming a rectangular tube with a stitched or glued overlapping seam on two side walls. The inside overlapping wall of each side wall extends a distance beyond the stitched or glued seam, so that this overlapping section is free to be folded inwardly away from the side wall. Each of these overlapping free side wall sections has three additional relatively closely spaced vertical folds. When folded on these lines, each side wall free end forms an integral, vertically extending triangular prism, with the free edge tucked in the seam overlap, which operates as a reinforcing post.

DESCRIPTION OF THE PREFERRED EMBODIMENT

Figure 1:
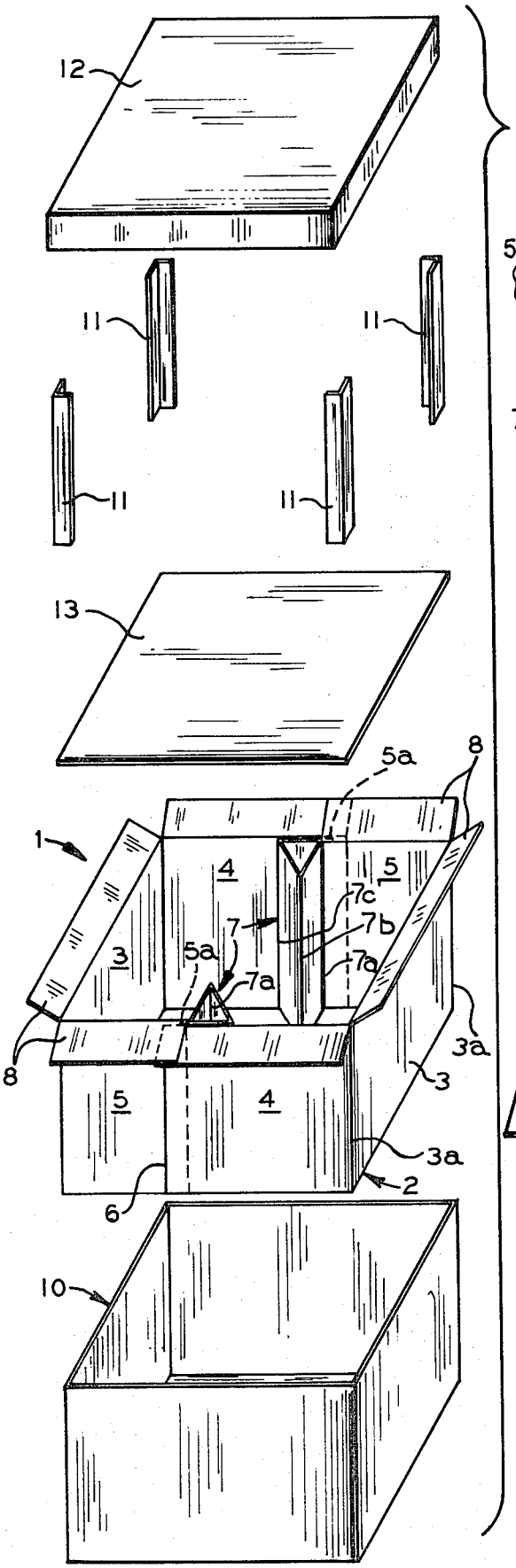
FIG. 1 is an exploded perspective view showing the parts of a shipping box embodying this invention.
Figure 2:
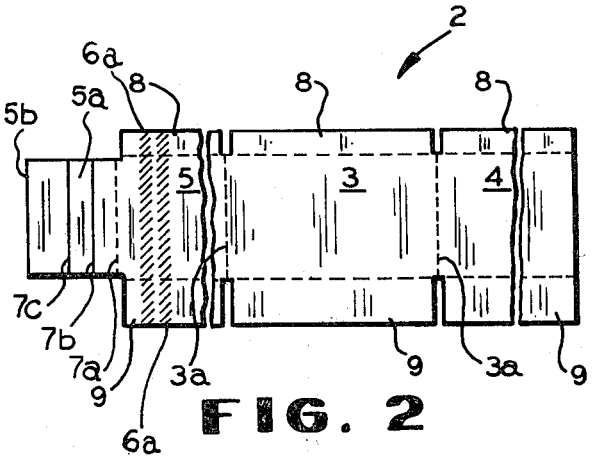
FIG. 2 is an elevational view of a corrugated blank used to form an end wall and parts of each side wall of the shipping box of FIG. 1.
Figure 3:
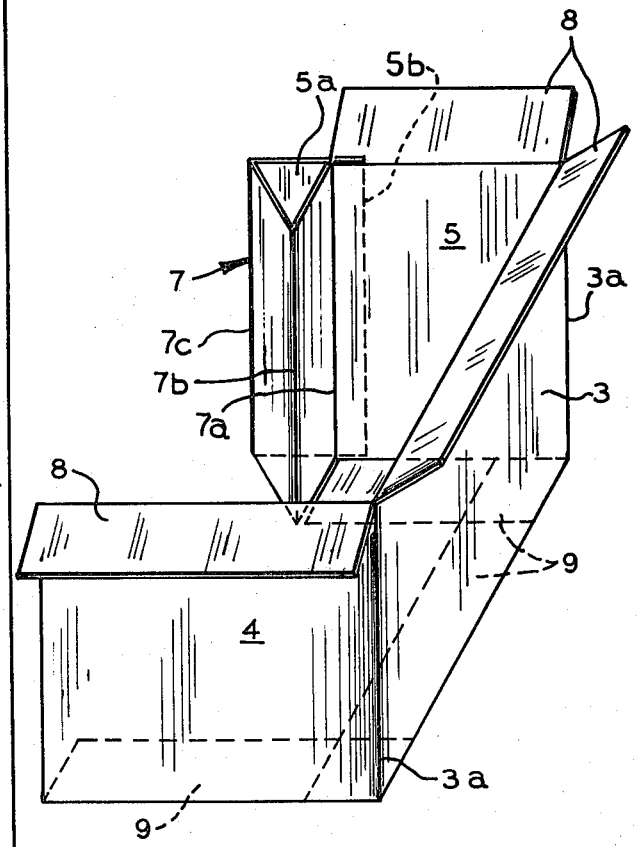
FIG. 3 is a perspective view of the side wall piece of FIG. 2 folded and ready to be joined with an identical piece to form a rectangular tube.

As illustrated in the drawings, the invention comprises a corrugated tube 1 formed from identical folded side wall pieces 2. Each side wall piece 2 is folded at scored vertical corner fold lines 3*a*, thereby forming an end wall 3, a shorter side wall section 4, a longer side wall section 5, and a free end wall portion 5*a* of wall 5. So folded, the two identical side wall pieces 2 are aligned in mirror image configuration with end wall sections 3 opposite each other. The side wall pieces 2 are brought together so that the shorter side wall sections 4 overlap on the outside of longer side wall sections 5. The two side wall sections are then attached at the overlap with a glued or stitched vertical seam 6 to form a rectangular tube 1. If glue is employed, a layer of glue 6*a* is applied to end wall 5, spaced from free end portion 5*a*. The seam 6 does not attach the end 5*a* of side wall section 5, leaving it free to be folded toward the interior of tube 1. Each free end 5*a* of side wall section 5 has three relatively closely spaced vertical fold lines 7*a*, 7*b*, and 7*c*. The free end 5*a* of each side wall piece 5 is folded on the vertical fold line 7*a*, towards the interior of the box, then folded in the opposite direction on lines 7*b*, 7*c* to form a vertically disposed triangularly shaped reinforcing post 7. Fold lines 7*a*, 7*b*, 7*c* become the vertical edges of the reinforcing post 7. Line 7*b* forms the apex of the vertical triangular post 7, extending towards the interior of box 1, and vertical fold lines 7*a* and 7*c* are adjacent the side walls of box 1. To maintain the triangular configuration of the reinforcing post 7, the free end edge 5*b* of wall section 5*a* is folded back and inserted in the seam overlap between the inner surface of wall section 4 and the outer surface of wall section 5, behind fold line 7*a*.

To provide additional stacking strength and bulge resistance the rectangular tube thus formed may be placed within a standard corrugated rectangular box 10, sized to snugly receive the assembled rectangular tube 1. The top edge of the tube 1 may be provided with reinforcing flanges 8. When the tube 1 is placed within the box 10, the flanges 8 are folded inwardly to reinforce the top edge of the bulk container. The flanges 8 can be interleaved or otherwise fastened to be held in their folded configuration during filling. Top closure can be effected through the use of a standard corrugated lid 12.

The tube 1 may also be provided with flaps 9 that fold inward to form bottom flaps. The flaps may cover the entire bottom, or, as illustrated, part of the bottom only, to reinforce the tube 1 for use with a bottom box 10. It will be apparent that either the top or bottom of the tube 1 may be provided with flaps. When bottom flanges but not flaps are used, the bottom open end of the tube 1 may be covered with a corrugated sheet 13.

As the completed bulk box is being filled with bulk material, vertical corner reinforcing posts 11 may be inserted at each inside corner of tube 1, at fold lines 3*a*. As the bulk material fills the box, it will hold the corner posts 11 in place. The corner posts 11 are pieces of corrugated board or laminated paper board formed in the configuration of a 90° angle, so that each corner post will fit within a corner of the tube 1 to provide additional stacking strength and bulge resistance at the corners.

It will be apparent to those skilled in the art that the same method of forming the triangular reinforcing posts could be used to form a tube having four posts, in which case four wall sections and four seams would be required. In view of the disclosure, further modifications of this invention will be apparent to those skilled in the art, and it is therefore intended that the scope of the invention be determined solely by the appended claims.

What is claimed is:

1. A reinforced corrugated shipping box for bulk materials comprising a pair of identical corrugated blanks each scored and folded on two vertical corners to form a vertical end wall and two vertical partial side walls terminating in vertical edges, the partial side walls of each blank being disposed in overlapping relationship with the partial side walls of the other said blank, a pair of vertical seams joining said overlapped partial side walls to form a tube, each said vertical seam being respectively disposed in spaced relationship from said vertical edge of the inside one of said overlapped partial side walls, thereby defining an integral free end portion on the inside of each side wall of the assembled tube between said vertical edge and said seam, each free end portion being folded inwardly on vertical fold lines to form a reinforcing post of triangular configuration, spaced from said end walls and said corners, that portion of said reinforcing post incorporating said vertical edge lying adjacent the respective side wall and spaced from said end walls, and means defining a bottom wall for cooperating with said tube.

2. The box of claim 1 wherein said means defining a bottom wall comprises a standard open top corrugated container having a bottom wall and upstanding side wall snugly surrounding said tube.

3. The box of claim 1 wherein said means defining a bottom wall comprises folding flaps on said corrugated blanks, said flaps being folded inwardly to cover the bottom of said tubes.

4. The reinforced corrugated shipping box of claim 1 wherein corners of said tube are internally reinforced by corner posts formed into the shape of a 90° angle.

5. The reinforced corrugated shipping box of claim 1, wherein at least one horizontal edge of said tube is reinforced by integral folding flange extensions of said corrugated blanks, folded inwardly on horizontal fold lines onto the outside surface of said box, thereby reinforcing the box perimeter.

6. The box of claim 1 wherein each said vertical edge is inserted between the said overlapping partial side walls, whereby the triangular configuration of each free end portion is maintained.

7. A reinforced corrugated shipping box for bulk materials comprising a corrugated tube of vertically disposed rectangular side walls, at least one of said side walls being formed of two overlapping walls, with at least one vertical seam joining said overlapping side walls, said one vertical seam being disposed in spaced relationship away from the vertical edge of the inner overlapping wall, thereby defining a free end portion on the inside overlapping wall between said edge and said seam, said free end portion being folded inwardly on a plurality of vertical fold lines into a triangular reinforcing post with said vertical edge being inserted between said overlapping walls, whereby the triangular configuration of said reinforcing post is maintained.

* * * * *